US006369750B1

(12) United States Patent
Altavilla

(10) Patent No.: US 6,369,750 B1
(45) Date of Patent: Apr. 9, 2002

(54) INKJET SYSTEM FOR PRINTING PHOTOREAL PRINTS

(75) Inventor: Alexander P. Altavilla, Vestal, NY (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/311,370

(22) Filed: May 13, 1999

(51) Int. Cl.[7] ..... B41J 2/17
(52) U.S. Cl. ..... 342/96
(58) Field of Search ..... 347/96, 98, 100, 347/101, 105; 530/201, 200

(56) References Cited

U.S. PATENT DOCUMENTS 3,870,435 A * 3/1975 Watanabe ..... 427/261
4,116,910 A 9/1978 Rudolphy
4,246,154 A 1/1981 Yao
4,443,223 A 4/1984 Kissling et al.
4,575,465 A 3/1986 Viola
4,783,376 A 11/1988 Sakaki et al.
4,879,166 A 11/1989 Misuda et al.
5,017,644 A 5/1991 Fuller et al.
5,100,471 A 3/1992 Winnik
5,104,730 A 4/1992 Misuda et al.
5,224,987 A 7/1993 Matrick
5,230,733 A 7/1993 Pawlowski
5,908,728 A * 1/1999 Sakaki et al. ..... 430/126
6,197,722 B1 * 3/2001 Irving et al. ..... 503/201

* cited by examiner

*Primary Examiner*—John Barlow
*Assistant Examiner*—Michael S Brooke
(74) *Attorney, Agent, or Firm*—Salzman & Levy

(57) ABSTRACT

The present invention is a process for fabricating color images using an ink jet printing system. Color formation is achieved using color dye forming chemistry used in silver halide photography. The images formed in this process are light fast, water fast and of a color gamut range similar to photographic media. The image substrate can be either a transparency or opaque media and the final image will be of photorealistic quality.

11 Claims, No Drawings

INKJET SYSTEM FOR PRINTING PHOTOREAL PRINTS

BACKGROUND OF THE INVENTION

1. Field of Invention

This invention relates to an inkjet system (jettable solutions and receiver sheets) suitable for use in an inkjet recording process. It relates in particular to inkjet systems where recorded images can be observed by both reflected and transmitted light. Inkjet prints used at this present time have a need for improvement in physical and handling properties, particularly in water fastness, bleeding, humidity stability, light stability, reduced printhead clogging, as well as for improved image quality. In addition to the above deficiencies, the present dye systems used in inkjet have a restricted color space reproduction (i.e., are not able to produce the color gamut the human eye sees).

A preferred embodiment of this invention is therefore directed at an inkjet recording system with improved handling and performance characteristics. In particular, this system will give a recorded image that will overcome the shortcomings of the present systems by giving images that are resistant to rubbing smears, and bleeding remain intact upon contact with water, have good stability to humidity and light fading and will not cause clogging of the printhead; however, of utmost importance, the dye images produced will have improved color gamut and a photoreal appearance. All these benefits are obtained by the formation of an insoluble chromophore insitu (i.e., within the receiver matrix of this system). Furthermore, these are the same chromophore molecules used in present silver halide color photography, so color rendition is expected to be of photorealistic quality.

Inkjet printing systems generally are of two types: continuous stream and drop-on-demand. In continuous stream inkjet systems, ink is emitted in a continuous stream under pressure through an orifice or nozzle. The stream is perturbed, causing it to break up into droplets at a fixed distance from the orifice. At the breakup point, the droplets are charged in accordance with digital data signals and passed through an electric static field, which adjusts the trajectory of each droplet in order to direct it to a gutter for recirculation or a specific location on a recording medium. In drop-on-demand systems, a droplet is expelled from an orifice to a position on a recording medium in accordance with digital data signals. A droplet is not formed or expelled unless it is to be placed on the recording medium.

This invention is intended for use in both types of systems. The continuous stream system may allow for more options in the practice of this invention by allowing for the in-line premixing of two reactants such as color former and alkali before droplet formation. However in this configuration recycling of unused components would not be feasible.

2. Background Art

The following list describes some of the major requirements of an inkjet recording system in order to achieve commercial success:

1. Sufficient ink absorbing capacity and ink receptivity of the receiver layer to prevent the ink/pigment from streaking and running during printing, even under conditions where several droplets are deposited in a rapid sequence onto the same spot.

2. Fast drying of the layer surface after printing of the image leading to prints free from tackiness.

3. Excellent color rendition, no change of print hue with time.

4. The ability to have a high-gloss surface. Chromophores must not have a dull, flat look.

5. Transparencies must be clear, transparent, light scatter-free.

6. Resistance of the surface of the image to rubbing smear.

7. Excellent water fastness and minimal bleeding of the produced images.

8. Excellent light fastness of the printed image.

9. Excellent archival stability (especially photoreal).

10. Chromophores that have proper spectral quality for producing excellent color rendition 11. Chromophores that have proper spectral quality so go as to have color gamut space capabilities similar to what the human eye can see.

12. Inks that do not cause clogging of printheads.

At the present time no available system successfully addresses all these requirements. A number of approaches have been attempted to achieve the requirements of a good inkjet print. Water fastness has been addressed by a variety of techniques. Thus solutions to the problem have been proposed for by specific formulations of the inks or alternatively by specific modifications of the receiving layer.

One approach to improve water fastness has been the use of reactive dyes (U.S. Pat. No. 4,443,223 Kissling et al) and U.S. Pat. No. 5,230,733 (Pawlowski et al) and references cited therein. Although some improvement has been achieved by this approach, in general, under the conditions of practical printing, the environment is less than optimal and therefore do not achieve full reaction of these dyes with a given binder.

Another approach to both water fastness and light fastness has been inks based on colloidal dye dispersions and polymers in inks. U.S. Pat. No. 5,100,471 (Winnik et al), U.S. Pat. No. 5,017,644 (Fuller et al), U.S. Pat. No. 5,224,987 (Matrick et al) U.S. Pat. No. 4,246,154 (Yao et al). Inks based on colloidal dyes as well as hot melt inks although yielding images of good light and water fastness do in most cases lack brilliance, color gamut and are not totally transparent.

The use of cationic polymers in the receiver layer in conjunction with acidic inks to induce water fastness as described in U.S. Pat. No. 4,783,376 (Sakaki et al) and U.S. Pat. No. 4,575,465 (Viola) do in general give good water fastness. Although water fastness can be gained with this method, severe drawbacks in light stability, archival stability, and hue shifts accompany this simple benefit.

The introduction of inorganic pigments, filters, minerals, metal salts, and metal oxide have been proposed. U.S. Pat. No. 4,116,910 (Rudolphy et al) claims improved light stability.

The addition of pigments and polymers to improve water fastness and drying is described in U.S. Pat. No. 5,104,730 (Misuda et al) and U.S. Pat. No. 4,879,166 (Misuda et al). They describe the use of porous recording sheets where the porous layer is mainly pseudo boehmite. Although a number of advantages are claimed using these methods, most layers obtained by these methods become very brittle with age, are slightly opaque and have steep color rendition thus poor color space. Improvements incorporated into the receiving layer and jettable solution, to meet the prestated requirements of modern inkjet printing technology, are therefore the objectives of this invention.

SUMMARY OF THE INVENTION

Accordingly, the object of the present invention is to provide a jettable color forming solution and a receiving media containing a color developer, thus forming an insitu chromophore for use in inkjet recording.

Another objective is to obtain water fastness without affecting stability to light.

Another objective is to obtain insitu chromophore formation below the surface of the receiving layer.

Another objective is to obtain chromophore having good stability to humidity and light.

Another objective is to obtain chromophore having excellent color gamut.

Another objective is to obtain an inkjet recording media having an extended color rendition.

It is a further objective to provide clear, light scatter-free recorded images for use on a transparent base. Another objective of the invention is to obtain images of superior luster and sharpness.

This invention proposes to achieve the above objectives by providing an inkjet recording system where the jetting head or cartridge contains solutions of color couplers of the photographic type. These heads or cartridges would contain a cyan dye coupler, a magenta dye coupler, and a yellow dye coupler. The receiver sheet would contain a color developing agent. Under the proper conditions of pH and oxidation (O), an insitu chromophore material would be formed. The general reaction would be the following.

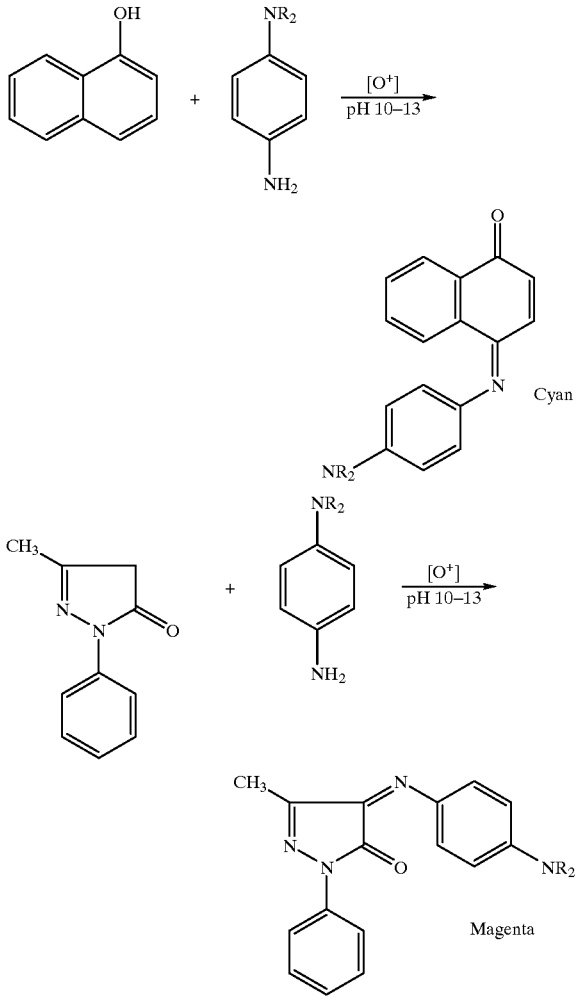

-continued

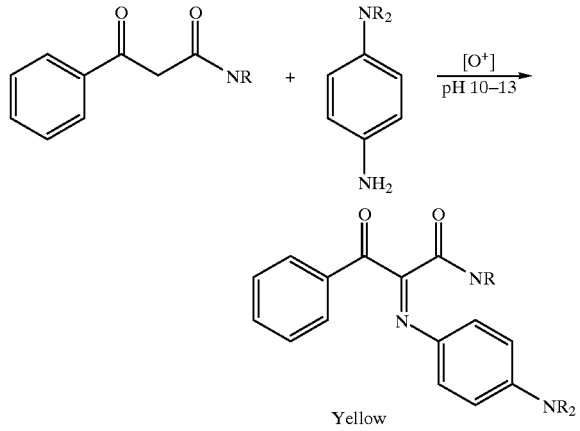

In all coupling reactions, an active methylene group and a p-phenylenediamine developer would be common. To the receiving layer or layers, a wide variety of additional elements may be added to further improve the pictorial, physical, and preserving properties of the images obtained when printing via a continuous or DOD inkjet printer.

This is also the option one has with the colorformer containing jettable solutions. A variety of items may be added to improve preserving qualities, density, image quality, water solubility, and reaction rate.

DESCRIPTION OF THE PREFERRED EMBODIMENT

The jettable color coupler solution would be stored in a cartridge or reservoir of a DOD or continuous inkjet printer. The cartridge or reservoir would be an individual container for a cyan coupler, a magenta coupler, and a yellow coupler. Based on a digital data signal, the coupler solution would be jetted onto a receiver sheet containing a para-phenylenediamine color developer. The basic color reactions are the following, although not limited to these specific molecules.

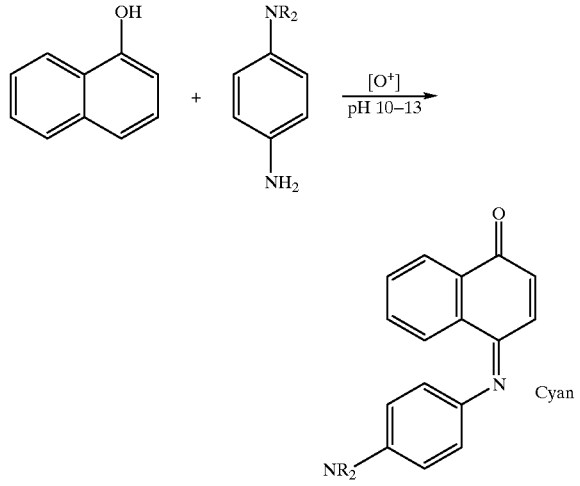

-continued

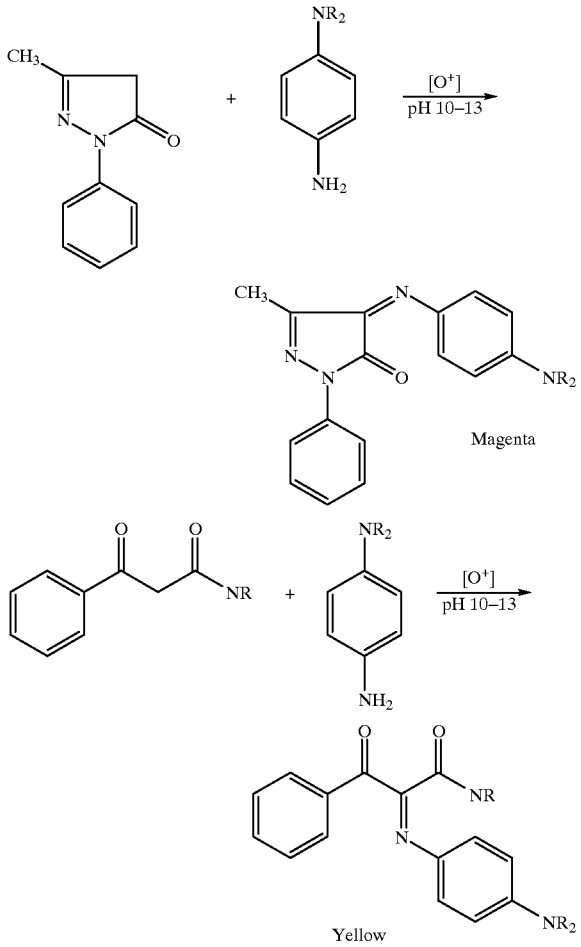

This is analogous to the color reaction in silver halide color photography. Thus one could envision all the benefits of that system's dye hue, stability, and color gamut with the use of a white light digital system.

Since the color reaction would take place within the layer of the receiver, the image chromophore would be protected from smudging and handling marks. The chromophore formed would also be aggregated, waterproof and light-fade resistant. This would be a distinct advantage over present dye inkjet systems, fade in light and humidity conditions are common, while pigmented inkjet systems suffer from smudging and low opacity.

The receiving layer to which the jettable color coupling solution is jetted, be it DOD or continuous inkjet method, would have coated the color developing agents in the matrix. The receiver could be a single layer or multilayered. Inclusive in the layer or layers could be antioxidants, pH regulators, coupling accelerators, and the many options noted in the following pages. Oxidizing agent might also be part of the receiving matrix. In this case, the antioxidant and developing agent are preferably contained in a separate layer.

The color developing agents derived from p-phenylediamine meet the requirements of this invention. Preferred typical color developing agents used in the invention are 4-(N-ethyl-N-2-hydroxyethyl)-2-methylphenylenediamine sulfate (CD-4), 4-amino-n-ethyl-N(beta-methoxyethyl)-3-methylaniline-di-para-toluenesulfonic acid, and 4-(N-ethyl-N-2-hydroxyethyl)-2-methylphenylenediamine sulfate. Typical examples are listed below.

Color Developing Agents

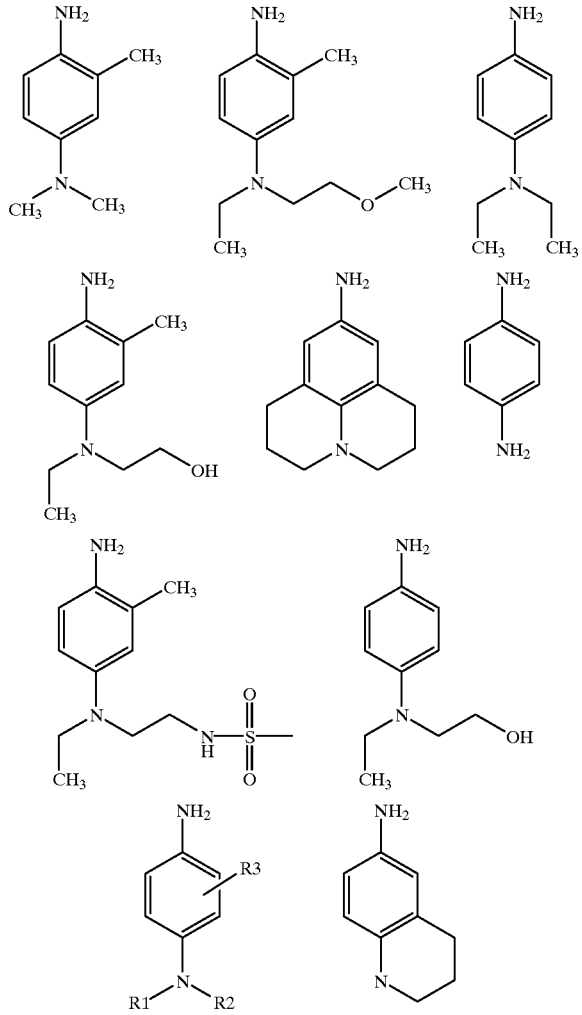

R1 = alkyl, aryl
R2 = alkyl, aryl, OH
R3 = alkyl, aryl, $SO_3H$, COOH

Typical oxidizing agents meeting the requirements of the invention to initiate coupling reaction to form a dye are the following: oxygen, hydrogen peroxide, organic peroxides, potassium chlorate, ammonoum nitrate, and sodium iodate. Also preferred are systems where the oxidant is complexed with a macromolecule or polymer. Examples include polyvinyl pyrrolidone and cyclodextrin complexed with hydrogen peroxide.

Antioxidants of value in the practice of this invention could be compounds such as sodium sulfite, sodium bisulfite, phenidone B, phenidone-S, ascorbic acid and vitamin E.

The compounds that make up the imbedding matrix of the receiver sheet holding the various components of the invention include, in general, water soluble film forming polymers. However, this is not exclusive. In the right formulary, non-water soluble polymers could be used. These film forming water soluble polymers may include, for example, natural polymers or modified products thereof such as albumin, gelatin, casein, starch, gum Arabic, sodium alginate, hydroxyethyl cellulose, carboxylemethyl cellulose or α- or β-cyclodextrin and the like; polyvinyl alcohol; complete or partially saponified products of copolymers of vinyl acetate and other monomers; homopolymers or copolymers with other monomers of unsaturated carboxylic acids such as (meth) acrylic acid, maleic acid, crotonic acid and the like; homopolymers or copolymers with other vinyl monomers of sulfonated vinyl monomers such as vinylsulfonic acid, sulfonated styrene and the like; homopolymers or copolymers with other vinyl monomers of (meth) acrylamide; homopolymers or copolymers with other monomers of ethylene oxide; polyurethanes, polyamides having such groups as mentioned above; polyethyleneimine, polyacrylamides, water soluble nylon type polymers, polyvinylpyrrolidone, polyester; and so on. All these can also be used in mixtures.

These polymers can be blended with non-water soluble natural or synthetic high molecular compounds.

Suitable synthetic polymer materials can be chosen from among polyvinyllactams, acrylamide polymers, polyvinyl alcohol and its derivatives, polyvinylacetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine.

Crosslinking agents suitable for this particular invention are selected depending on the water soluble polymer used.

They may include, for example, chromium salts (such as chrome alum or chromium acetate), aldehydes (such as formaldehyde, glyoxal or glutaraldehyde), N-methylol compounds (such as dimethylolurea or methyloldimethylhydantoin), dioxane derivatives (such as 2,3-dihydroxydioxane), activated vinyl compounds (such as 1,3,5-triacrylolyl hexahydro-s-triazine or bis(vinylsulfonyl) methyl ether), activated halogen compounds (such as 2,4-dicholo-6-hydroxy-s-triazine), amino or substituted-amino modified triazines, epoxies, carbamoylpyridinium compounds or mixtures of two or more of above mentioned crosslinking agents.

The layers and coatings can be modified by addition of fillers. Possible fillers of the kind are for instance clay, kaolin, talcum, Ca—, Mg, or Ba-carbonate, Ca or Ba-sulphate, silica, titanium oxide, chalk, bentonite, zeolite, aluminum silicate, calcium silicate, silicium oxide, satin white, colloidal silicium oxide and the like. Likewise the possibility exists to use organic inert particles such as polymer beads. This includes beads that can be made from polyacrylates, polystyrene or different copolymers of acrylates and styrene. These fillers are selected according to the intended use of the printed image.

Some of these compounds cannot be used if the printed image is to be used as a transparency. Alternatively they are of interest in cases where the printed image is to be used as a reflected image. Often the introduction of such filler causes a desired matte surface.

The image recording elements of this invention comprise a support for the ink receiving layer. A wide variety of such supports are known and commonly employed in the art. They include, for example, those supports used in the manufacture of photographic clear films including cellulose esters such as cellulose triacetate, cellulose acetate propionate or cellulose acetate butyrate, polyesters such as poly (ethylene terephthalate), polyamides, polycarbonates, polyimides, polyolefins, poly(vinyl acetals), polyethers, polyvinyl chloride and polysulfonamides, Polyester film supports and especially poly(ethylene terephthalate) are preferred because of their excellent dimensional stability characteristics.

Likewise the usual supports commonly used in manufacturing of opaque photographic material can be used according to the present invention. They include baryta paper, polyethylene-coated paper, polypropylene synthetic paper, voided polyester as for instance manufactured by ICI under the trade name of MELINEX as well as voided polypropylene polyester likewise manufactured by the same company. Preferred are clear polyester, acetate, voided polyester or resin coated paper.

When such support material, in particular polyester, is used a subbing layer is advantageously added first to improve the bonding of the ink receiving layer to the support. Useful subbing compositions for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers. Also usable are plain paper, comprising a wide variety of sizing, cast-coated papers and aluminum foils.

The ink receiving layers or coatings according to this invention are in general coated from aqueous solutions or dispersions containing binders, additives, colorless pigments and the like. It is in many cases necessary to add surfactants to those coating solutions or dispersions allowing for smooth coating and evenness of the layers.

Examples of suitable surfactants are nonionic surface active agents such as saponin (steroids), alkylene oxide derivatives (such as polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamine or amides or silicone/polyethylene oxide adducts), glycidol derivatives (such as alkenylsuccinic acid polyglycerides or alkylphenol polyglycerides), aliphatic esters of polyhydric alcohol, alkyl esters of sucrose, urethanes or ethers; a sulfuric acid ester group or a phosphoric acid ester group, such as triterpenoid type saponin, alkylcarboxylates, alkylsulfonates, alkylbenzenesulfonates, alkylnaphthalenesulfonates, alkyl sulfuric acid esters, alkyl phosphoric acid esters, N-acyl-N-alkyltaurines, sulfosuccinates, sulfo-alkylpolyoxyethylene alkylphenyl ethers or polyoxyethylene alkyl-phosphates and cationic surface active agents such as alkylamine salts, aliphatic or aromatic quaternary ammonium salts (such as pyridinium or imidazolium salts) or phosphonium or sulfonium salt containing an aliphatic or heterocyclic ring. Equally suitable are fluorinated or perfluorinated derivatives of the above mentioned compounds.

Specific examples of these surface active agents are those described in e.g. U.S. Pat. Nos. 2,240,472, 1,831,766, 3,158,484, 3,210,191, 3,294,540 and 3,507,660; British Pat. Nos. 1,012,495, 1,022,878, 1,179,290 and 1,198,450; U.S. Pat. No. Nos. 2,739,891, 2,823,123, 3,068,101, 3,415,649, 3,666,478 and 3,756,828; British Pat. No. 1,397,218; U.S. Pat. No. 1,397,218; U.S. Pat. Nos. 3,133,816, 3,441,413, 3,475,174, 3,545,974, 3,726,683, and 3,843,368; Belgium Pat. No. 731,126; British Pat. Nos. 1,138,514, 1,159,825, and 1,374,780; 2nd U.S. Pat. Nos. 2,271,623, 2,288,226, 2,944,900, 3,253,919, 3,671,247, 3,772,021, 3,589,906, and 3,754,924 all incorporated by reference.

Besides being necessary for coating purpose, surfactants may have an influence on the quality of the generated images and may therefore be selected with this specific goal in mind. There is in general no limitation to the use of the types of surfactants used.

Typically the receiving layers according to this invention have a thickness in the range of 0.5 to 30 microns, preferably in the range of 2.0 to 15 microns dry thickness. The coating solutions or coating dispersions can be coated onto a support by any number of suitable procedures. Usual coating methods include immersion or dip coating, roll coating, air knife coating, extrusion, doctor blade coating, rod and/or blade metering, or by spraying. An ink receiving system can be built up by several layers.

These layers can be coated one after the other or simultaneously. It is likewise possible to coat a support on both sides with ink receiving layers.

Alternatively, the backside may be coated with auxiliary layers like for instance anticurl layers or antistatic layers. The way however by which the claimed receptive layers are produced is not to be considered limiting for the present invention.

In addition to the above mentioned elements, ink receiving layers, as claimed in this invention, can contain additional additives aimed at improving appearance as well as performance of the produced imaging material. It can, for instance, be beneficial to add brightening agents to the layers of receiving sheets. There is in general no limitation as to the kind of brighteners used. Suitable brightening agents are for instance stilbenes, coumarines, triazines or oxazoles or others known in the art.

Light stability can in general be improved further by adding UV absorbers to the layers. Although UV absorbers are in general added to the topmost layer of the system there is no limitation as to where within the ink receiving element such light absorbing compounds are added. The amount of UV-absorber can vary from 200–2,000 mg/m$^2$ , preferably however from 400 mg to 1,000 mg/m$^2$. Suitable types of absorbers can be for example benztriazoles, benzophenones, derivatives of acrylonitrile, thiazolidone, oxazole and thiazole.

It is further known that images can be protected from degradation by the addition of light stabilizers and antioxidants. Examples of such compounds are among others sterically hindered phenols, sterically hindered amines, chromanols and the typical antioxidants include nitrate salts, gallate esters, tocopherol, mercapto heterocycles, and sulfite salts.

Above mentioned additives can, if water soluble, be added as aqueous solutions. In the case where these compounds are not water soluble, the above mentioned additives can be incorporated in the ink receiving element by common techniques known in the art. The compound is typically dissolved in a solvent selected from organic solvents compatible with water, such as alcohol, glycol, ketones, esters, amides and the like. Alternatively the compounds can be added to the layer as fine dispersions, as oil emulsions, as a cyclodextrin inclusion complex or loaded as fine dispersions onto latex particles. Ultrasound or milling can be used to dissolve or disperse marginally soluble additives.

Inks for ink jet printing are well known. These inks consist in essence of a liquid vehicle and dissolved or suspended therein a dye or pigment. The jettable solution in this invention would not be a dye or pigment, but a colorless solution of a color coupler having the ability to form a dye or pigment when contacting the receiver sheet containing the color developing agent.

The liquid vehicle of the color couplers employed in this invention consist in general of water, a compound for control of pH (NaOH, KOH, etc.), and an oxidizing agent. Usable oxidizers include hydrogen peroxide, oxygen, mercuric chloride, potassium chlorate, ammonium nitrate, ammonium picrate, and organic peroxides.

The invention should not be limited to these specific compounds but could include other oxidizing agents that do not impart color to the matrix and have the capability of oxidizing the paraphenylene developing agent. The general class of compounds to be used as color coupling agents that form cyan, magenta, and yellow chromophoric materials would have an active methylene group contained in the molecule. Specific examples of these color coupling types are contained herein below. The invention is not limited to these specific examples. Any compound having an active methylene group capable of forming a chromophore with a color developer would be included. Also a combination of these couplers could be used.

Magenta Color Couplers

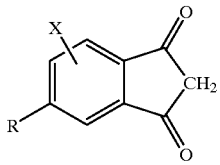

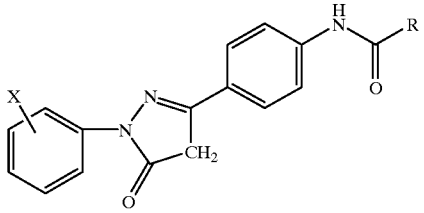

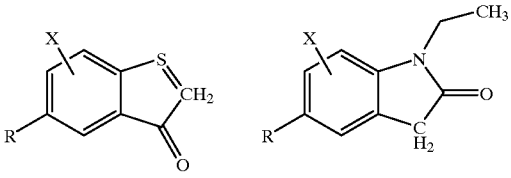

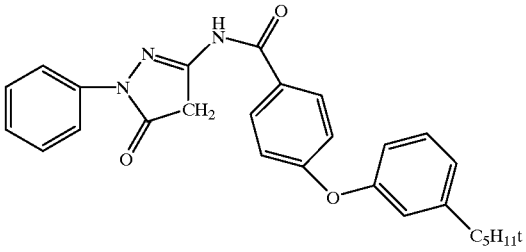

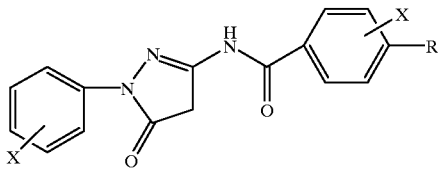

-continued
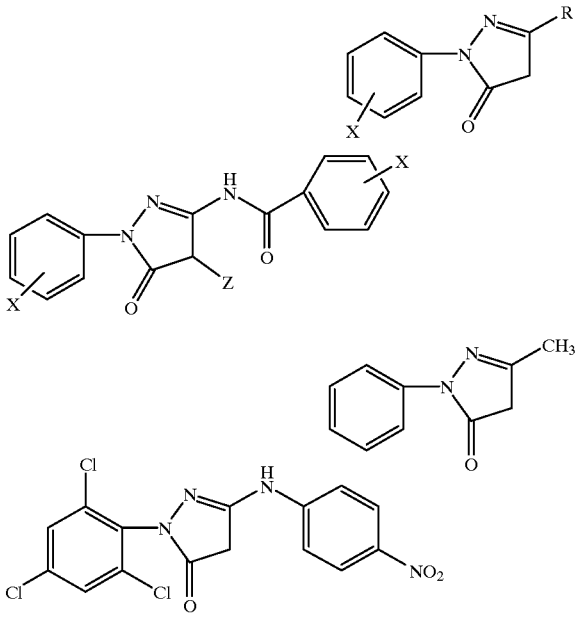
X = $SO_3H$, COOH
R = aliphatic, OR, alkyl
Z = halogen, COOH, $SO_3H$
Cyan Color Couplers
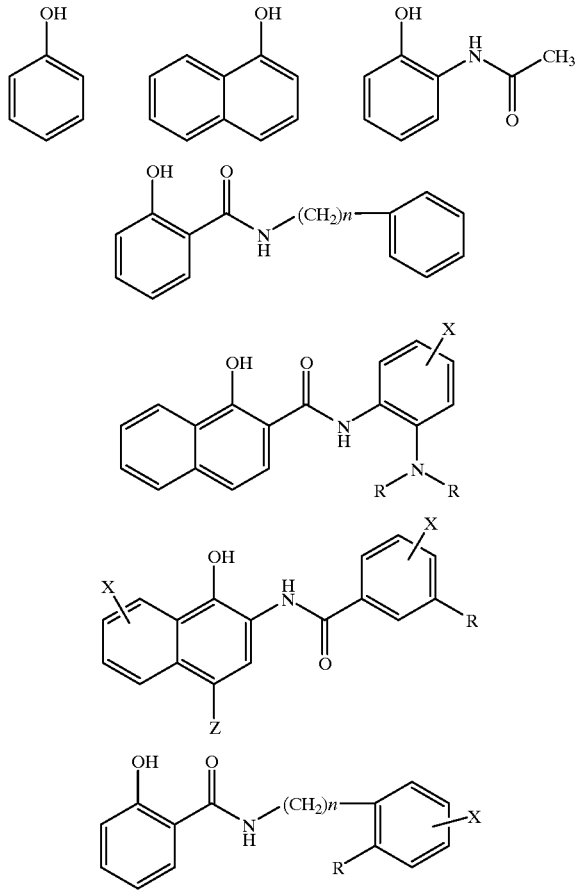
-continued
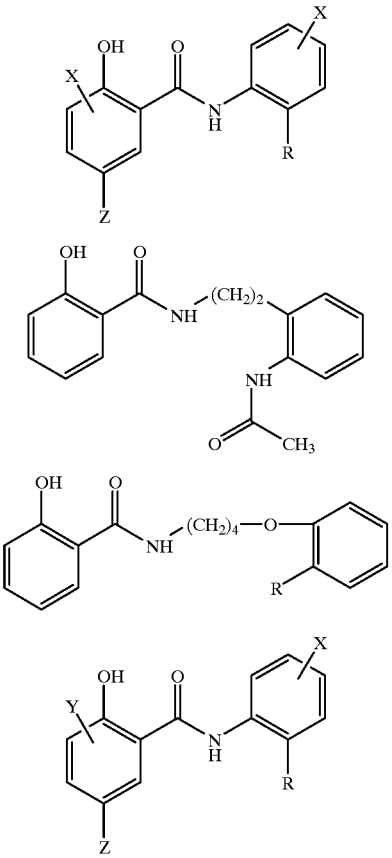
X = $SO_3X$, COOH
R = aliphatic, OR, alkyl
Z = halogen, COOH, $SO_3H$
Y = halogen, alkyl
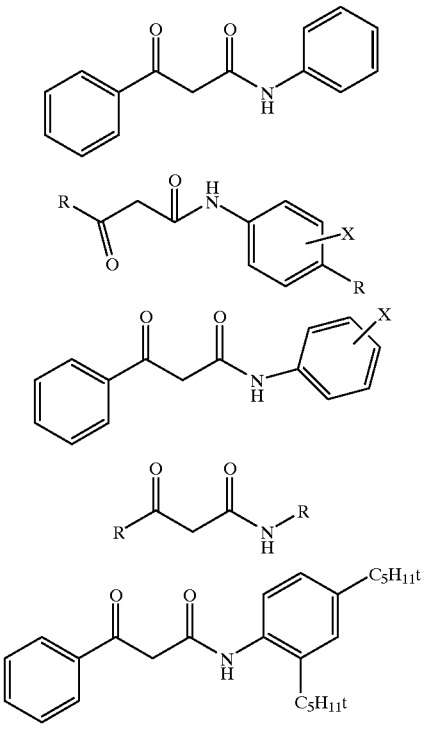

-continued

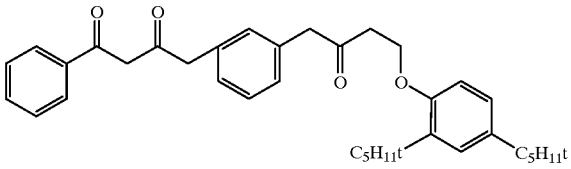

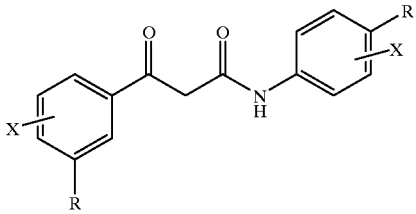

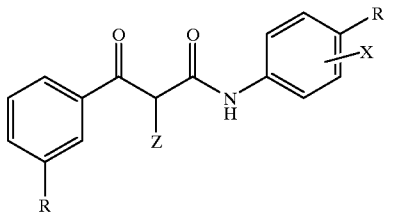

X = COOH, $SO_3H$
Z = halogen, COOH, $SO_3H$
R = aliphatic, OR, alkyl

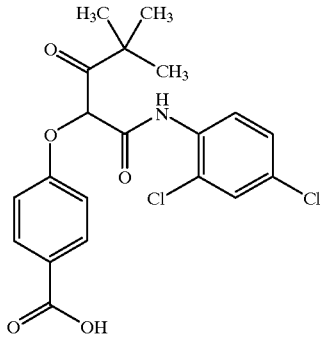

Other compounds that might be contained in the jettable color coupling solution could be water miscible organic components such as ethylene glycol, higher molecular glycol, glycerin, dipropylene glycol, polyethylene glycol, amides, polyvinypyrrolidone, N-methylpyrrolidone, cyclohexylpyrrolidone, carboxylic acids, and esters, ethers, alcohol, organsulfoxides, sulfolane, dimethylforamide, triethylamine, dimethylsulfoxide, cellosolve, polyurethanes acrylates and the like.

Aqueous compatible components of the printing solution generally serve as humecfactant, cosolvent, viscosity regulating agent, penetrating agent, leveling agent or drying agent. These components, typically organic, have in most cases a boiling point higher than that of water. In addition, aqueous inks may contain inorganic or organic salts to impart electrical conductivity. Examples of such salts include nitrates, chlorides, phosphates and the like. Organic acid of low molecular such as acetic, oxalic and similar may also be used.

Other additives present in the jettable coupler solution might be surfactants, optical brighteners, UV absorbers or light stabilizers, biocides and polymer additives. This description of jettable color coupler solutions is for illustration only and not to be considered as limiting the invention.

EXAMPLE #1

| Coating Solution #1 | | | |
|---|---|---|---|
| Gelatin* | 1.5 gms | CD-3, 5% in deionized $H_2O$ | 10 gms** |
| Deionized water | 27.5 gms | Solution pH 11.0 (NaOH) | |

*Limed bone gelatin available from Rousselot, France.
**Paraphenylenediamine developer available from Eastman Kodak, United States

| Solutions A-C | | |
|---|---|---|
| Solution A | Solution B | Solution C |
| Coupler C-16** 1 g | Coupler M-38*** 1 g | Coupler Y-55**** 1 g |
| Deionized water 19 g | Deionized water 19 g | Deionized water 19 g |
| 5% NaOH to bring pH to 12.0 | 5% NaOH to bring pH to 12.0 | 5% NaOH to bring pH to 12.0 |

**Coupler C-16 (Cyan) available from Eastman Kodak.
***Coupler M-38 (Magenta) available from Eastman Kodak.
****Coupler Y-55 (Yellow) available from Eastman Kodak.

The coated layer (receiver sheet #192) containing the color developer CD-3 was prepared as follows: the gelatin and deionized water were combined at R.T. and allowed to soak and swell for 30 minutes.

The gelatin was melted at 55° C. for 30 minutes until in solution. An aqueous 5% solution of CD-3 was prepared by heating gently to 60° C., using deionized water and CD-3 solid. To this was added dropwise 5% NaOH solution until all solids went into solution approximate pH 12.0. The CD-3 solution was then added to the gelatin solution at 40° C. This combined solution of gelatin and CD-3 was then coated by means of a wire bar #75 onto a polyester film base and allowed to dry.

The three jettable color coupler solutions A, B, and C were prepared in the following manner: the solid coupler was added to the deionized water and heated gently to 50° C. To that mixture was added dropwise the 5% sodium hydroxide until all solids went into solution (pH approximate 12.0) and time 5 minutes.

The coupler solutions A, B, and C were applied onto the receiver sheet #192 using a micropipette. A cyan dye was formed with solution A, a magenta dye with solution B and a yellow dye with solution C. Oxygen, present from dissolved air in the solutions, acts as an oxidizing agent.

All three dyes had good hue and densities above 3.0 units.

EXAMPLE #2 (Coating 0193)

| Coating Solution #2 | |
|---|---|
| Methocel F-50* | 1.5 gms |
| Ethanol | 11.4 gms |
| Deionized $H_2O$ | 17.1 gms |
| CD-3, 5% Deionized $H_2O$ | 10.0 gms |

*Methocel F-50 carboxlated cellulose available at Dow Chemical Corporation.

The coated layer containing the color developer CD-3 was prepared the same as example #1. The solution again was coated at 40° C. using a number #75 round rod on polyester terphthalate film base.

The receiver sheet was again treated with microdrops of the coupler solutions A, B, and C. The results were the same as in example one. Dyes were formed within the layer having good hue and density. They showed resistance to smudging and water solubility.

COATING EXAMPLES (3–6)

| Solution #1 | (0272) Example 3 | (0273) Example 4 | (0274) Example 5 | (0275) Example 6 |
|---|---|---|---|---|
| Gelatin 5% in $H_2O$ | 30 cc | 30 cc | 30 cc | 30 cc |
| 5% CMC Aquelon L-7 in $H_2O$*** | 30 cc | 30 cc | 30 cc | 30 cc |
| KI 75% in $H_2O$ | 15 cc | 15 cc | 15 cc | 15 cc |
| F-75**** (5% in Niaproof water) | 0.5 cc | 0.5 cc | 0.5 cc | 0.5 cc |
| **Solution** | **#2** | **#3** | **#4** | **#5** |
| $H_2O$ | 20 cc | 20 cc | 20 cc | 20 cc |
| Sodium Sulfite | 2.0 g | 2.0 g | 2.0 g | 2.0 g |
| Phenidone "B" (wet with EtOH) | 0.08 g | 0.08 g | 0.08 g | 0.08 g |
| CD-3 | 4.0 g | — | — | 1.5 g |
| CD-6* | — | 4.0 g | — | 1.5 g |
| CD-4** | — | — | 4.0 g | 1.5 g |
| Add 5% NaOH until clear | Approx 5 cc | Approx 5 cc | Approx 5 cc | Approx 5 cc |
| Adjust pH of combined Solution # 1 and #2–#5 | 7.0 | 7.0 | 7.0 | 7.0 |

*CD-6 color developer (paraphenylenediamine) available from Eastman Kodak.
**CD-4 color developer (paraphenylenediamine) available from Eastman Kodak.
***CMC L-7 Carboxymethyl Cellulose Mfg. by Aquelon Corporation.
****F-75 Anionic Surfactant Niaproof (Mfg. by Niacet).

The gelatin and CMC are prepared as separate 5% solutions in $H_2O$. Both solutions had a room temperature digest followed by gentle heating 50° C. for 30 minutes until in solution. The KI is dissolved at room temperature in $H_2O$ using 75 g KI and 25 gms water. The Niaproof is 5% active ingredient in $H_2O$. The above compounds are combined in the order listed to form solution #1 at 40° C.

Coating solution numbers 2, 3, 4 and 5 are prepared by addition of the compounds in the order listed with gentle heating at 50–60° C.

Coating solution two is added to coating solution one at 40° C. to form example #3; coating solution three is added to a second aliquot of coating solution one to form example #4; coating solution four is added to coating solution one to form example #5; and coating solution #5 is added to coating solution one to form example six.

The coating solutions #2–5 from examples 3–6 are wound rod coated on clear film base, opaque base, resin coated paper, and baryta paper. The coating temperature was 40° C. and the dry coating thickness was 8 microns.

Color Coupling Solutions D, E, and F

| | Solution D | Solution E | Solution F |
|---|---|---|---|
| DI Water | 50 cc | 50 cc | 50 cc |
| Sodium Sulfite*** | 0.5 g | 0.5 g | 0.5 g |
| Glycerine 50% in water** | 13 cc | 13 cc | 13 cc |
| 1,5 Pentanediol* | 5 cc | 5 cc | 5 cc |
| Phenidone "B" | 0.10 g | 0.10 g | 0.10 g |
| C-16 coupler | 4.0 g | — | — |
| M-38 coupler | — | 4.0 g | — |
| Y-55 coupler | — | — | 4.0 g |
| KI 75% in $H_2O$ | 10 cc | 10 cc | 10 cc |

-continued

Color Coupling Solutions D, E, and F

| | Solution D | Solution E | Solution F |
|---|---|---|---|
| F-75 (Anionic surfactant) | 1.0 cc | 1.0 cc | 1.0 cc |
| pH adjust with NaOH | pH 11 | pH 11 | pH 11 |

*1,5 Pentanediol humectant available from Aldrich Chemicals..
**Glycerine humectant available from Aldrich Chemicals.
***Sodium Sulfite anitoxidant available from Aldrich Chemicals.

Microdrops of coupling solutions D, E, and F were added to the receiver sheets of examples three through six. In each case, a cyan, magenta, and yellow dye was formed in the receiver sheet independent of the type of base support used. Again the densities were above 3.0 and the hue was good. In addition, secondary colors were formed by adding microdrops of solutions D and F in the same spot on the receiver sheets, a green color was produced. Solutions E and F treated in a similar manner gave red and solution D and E gave blue. If all three coupling solutions were added as microdrops in the same areas on the receiver sheets, a black was produced. Another test to demonstrate the inventions was the loading of blank color cartridges of a Hewlett Packard 560 inkjet printer with color coupler solutions D, E, and F respectively. The standard Hewlett Packard pigmented ink was left in the black cartridge. Digital data of a test pattern having a cyan, magenta, yellow, red, green, and blue step wedge of 11 steps was printed. Also included in this digital data pattern was red, green and blue strips, a color bleed pattern of all the additive and subtractive color of photography. This digitized image was computer fed to the Hewlett Packard 560 desk jet and printed on example #3 (0272) receiver sheet. A clear, crisp image appeared as the color couplers jetted onto the receiver sheet containing the CD-3, CD-6, and CD-4 coating 0275 reacted. Upon drying, the sheet was smudge proof, durable, and it had good hue and image quality. The liquid vehicle of the color couplers employed in this invention consist in general of water, a compound for control of pH (NaOH, KOH, etc.), and oxidizing agent. Usable oxidizers, hydrogen peroxide, mercurie, chloride, potassium iodide, and vranylnitrate. The invention would not be limited to these specific compounds but could include any oxidizing agent. The general class of compounds to be used as color coupling agents that form cyan, magenta, and yellow dye would have an active methylene group contained in the molecule. Specific examples of these color coupling types are contained on the following pages. The invention is not limited to these specific examples. Any compound having an active methylene group capable of forming a dye with a color developer would be included. Also combination of these couplers could be used. Other compounds that might be contained in the jettable color coupling solution could be water miscible organic components such as ethylene glycol, higher molecular glycol, glycerin, diprophlene glycol, polyethylene glycol, amids, polyvinypyrrolidone, N-methylpyrrolidone, cyclohexylpyrrolidone, caboxylic acids, and esters, ethers, alcohols, organsulfoxides, sulfolane, dimethylforamide, triethylamine, dimethylsulfoxyde, cellosove, polyurethanes acrylates and like.

The non-water part of the printing solution generally serve as hume factant, cosolvent, viscosity regulating agent, penetrating agent, leveling agent or drying agent. The organic components have in most cases a boiling point higher than that of water. In addition, aqueous inks may contain inorganic or organic salts to impart electrical conductivity. Examples of such salts nitrates, chlorides, phosphates and the like. Organic acid of low molecular such as acetates, oxalates and similar may also be used.

Other additives present in the jettable coupler solution might be surfactants, optical brighteners, UV absorbers or light stabilizers, biocides and polymer additives. This description of jettable color coupler solutions is for illustration only and not to be considered as limiting the invention.

What is claimed is:

1. A process for generating a photorealistic color image having improved waterfastness, dye fade, smudge resistance and color gamut comprising the steps of a) providing a receiving sheet comprising a support and at least one receiving layer comprising a hydrophilic polymer and a color photographic developer, said receiving layer coated on at least one of the outermost surfaces of said support;

b) applying, in a imagewise fashion, a liquid pre-dye formulation comprising a photographic color coupler, an alkaline compound and an oxidizing agent to said receiving layer to create a combination of said photographic color coupler, said photographic color developer, said oxidizing agent and said alkaline compound within said imaged areas of said receiver layer, and c) allowing said combination within said receiving layer to react to provide a color image; with the proviso that the oxidizing agent is not a silver salt.

2. The process as described in claim 1, wherein said liquid pre-dye formulation is imagewise applied to said receiver sheet via continuous or drop-on-demand ink jet recording heads.

3. The process as described in claim 2, wherein the liquid pre-dye formulation comprises said photographic color coupler, said oxidizing agent, and a sufficient amount of said alkaline compound to provide an optical dye density >2, and said receiving layer in step (a) comprises said hydrophilic polymer and said photographic color developing agent.

4. The process as described in claim 3, wherein said oxidizing agent is bound to a complexing agent.

5. The process as described in claim 4, wherein said oxidizing agent is hydrogen peroxide and said complexing agent is polyvinylpyrrolidone or cyclodextrin.

6. The process as described in claim 2, wherein said photographic color developing agent is selected from the group consisting of N,N disubstituted paraphenylene diamine derivatives.

7. The process as described in claim 2, wherein said photographic color coupler is selected from a group consisting of cyan, magenta, and yellow color couplers containing two or four equivalent couplers.

8. The process as described in claim 7, wherein said liquid pre-dye formulations comprising cyan, magenta, and yellow photographic color couplers are individually placed in separate cartridges and applied via separate said ink jet recording heads to said receiver sheet to generate a full color gamut printed image.

9. The process described in claim 7, wherein said color image comprises azomethine and indoaniline dyes.

10. The process as described in claim 2, wherein said oxidizing agent is selected from the group consisting of oxygen, alkali iodate salts, alkali chlorate salts, hydrogen peroxide and organic peroxides.

11. The process as described in claim 2, wherein said alkaline compound is selected from the group consisting of ammonium hydroxide, alkali and alkaline hydroxides and organic amines.

* * * * *